US010677512B1

(12) United States Patent
Contin et al.

(10) Patent No.: US 10,677,512 B1
(45) Date of Patent: Jun. 9, 2020

(54) APPLIANCE PUSH-TO-OPEN SYSTEM AND METHOD OF INSTALLING THE PUSH-TO-OPEN SYSTEM

(71) Applicant: Whirlpool Corporation, Benton Harbor, MI (US)

(72) Inventors: Paolo Contin, Vergiate (IT); Piotr Jozef Grzyb, Wroclaw (PL); Matteo Moroni, Milan (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/263,738

(22) Filed: Jan. 31, 2019

(51) Int. Cl.
*F25D 23/02* (2006.01)
*E05B 65/00* (2006.01)

(52) U.S. Cl.
CPC ..... *F25D 23/028* (2013.01); *E05B 65/0042* (2013.01); *F25D 2323/023* (2013.01); *F25D 2323/024* (2013.01)

(58) Field of Classification Search
CPC ..... F25D 23/028; F25D 2323/023; F25D 2323/024; F25D 23/025; E05B 65/0042; E05Y 2900/31
See application file for complete search history.

(56) References Cited

U.S. PATENT DOCUMENTS 4,514,021 A * 4/1985 Sundermeier ..... E05D 3/06 312/291
4,626,049 A * 12/1986 Gross ..... E05D 7/0407 312/291
6,079,216 A * 6/2000 de Marsillac Plunkett ..... A47G 29/20 109/7
9,101,086 B2 * 8/2015 Huang ..... H05K 5/0239
9,125,546 B2 * 9/2015 Kleemann ..... A47L 15/4265
9,228,386 B2 * 1/2016 Thielmann ..... E05F 17/002
10,386,112 B2 * 8/2019 Nordieker ..... F25D 23/028
2005/0005397 A1 * 1/2005 Gomoll ..... E05F 5/027 16/286
2005/0062293 A1 * 3/2005 Shen ..... E05C 19/022 292/137
2006/0226751 A1 * 10/2006 Park ..... F25D 23/02 312/405.1
2007/0103041 A1 * 5/2007 Kropf ..... E05C 19/022 312/333
2007/0103043 A1 * 5/2007 Kropf ..... A47B 88/463 312/334.5
2007/0176526 A1 * 8/2007 Gomoll ..... A47B 77/08 312/401
2010/0231111 A1 * 9/2010 Kang ..... E05D 3/022 312/405
(Continued)

*Primary Examiner* — Hanh V Tran
(74) *Attorney, Agent, or Firm* — Diederiks & Whitelaw, PLC.

(57) ABSTRACT

An appliance is installed within a cabinet such that the appliance is not visible from outside the cabinet when a cabinet door of the cabinet is closed. The appliance includes a compartment and an appliance door that selectively seals the compartment. A push-to-open system is coupled to the appliance door. The push-to-open system includes an arm, a push latch and a spring. The arm connects the appliance door to the cabinet door, and the push latch selectively locks the arm in a locked position. The spring causes movement of the arm from the locked position to an unlocked position when the push latch is unlocked.

21 Claims, 11 Drawing Sheets

(56) References Cited

U.S. PATENT DOCUMENTS

| | | | | |
|---|---|---|---|---|
| 2011/0068671 | A1* | 3/2011 | Vanini | E05F 5/02 312/405 |
| 2011/0198975 | A1* | 8/2011 | Barkau | A47B 88/457 312/319.1 |
| 2011/0254416 | A1* | 10/2011 | Salice | E05F 5/003 312/319.1 |
| 2012/0055091 | A1* | 3/2012 | Backherms | A47L 15/4259 49/31 |
| 2013/0212835 | A1* | 8/2013 | Lanzani | E05D 3/14 16/287 |
| 2014/0009055 | A1* | 1/2014 | Cho | E05C 1/08 312/405 |
| 2014/0139083 | A1* | 5/2014 | Beni | A47B 77/08 312/242 |
| 2016/0161175 | A1* | 6/2016 | Benold | F25D 23/08 312/405 |
| 2016/0235201 | A1 | 8/2016 | Söö | |
| 2017/0010038 | A1* | 1/2017 | Nordieker | E05B 17/06 |
| 2018/0283077 | A1* | 10/2018 | Lee | E05F 15/70 |
| 2018/0347892 | A1* | 12/2018 | Kim | E05F 15/619 |
| 2019/0056168 | A1* | 2/2019 | Choi | F25D 23/02 |
| 2019/0285335 | A1* | 9/2019 | Hunter | F25D 23/028 |

* cited by examiner

APPLIANCE PUSH-TO-OPEN SYSTEM AND METHOD OF INSTALLING THE PUSH-TO-OPEN SYSTEM

BACKGROUND OF THE INVENTION

The present invention pertains to the art of domestic appliances and, more particularly, to a push-to-open system for a domestic appliance, such as a refrigerator.

Frequently, homeowners are concerned not just with the functionality of their kitchens but also the aesthetics. Minimalism is one popular design style that is especially prevalent in the premium segment of certain markets. Minimalist designs often feature cabinets that lack handles, as well as appliances hidden behind the cabinets (i.e., built-in appliances). This presents a challenge in that the user needs to have a way to open the door of an appliance located within a handle-less cabinet.

For standard cabinets (i.e., those not concealing an appliance), a push-to-open system is sometimes used where pushing inward on the cabinet door triggers the system, which then pushes the door outward so that the user can reach between the door and the remainder of the cabinet to fully open the door. Although this works well for the relatively lighter doors of standard cabinets, when a cabinet door is used as or coupled to an appliance door, such as a refrigerator door of a built-in refrigerator, the weight of the door, as well as the seal provided by a refrigerator door, makes it difficult for a typical push-to-open system to push the door outwards a sufficient distance.

To address this problem, electromechanical push-to-open systems have been developed. However, such systems are larger and more expensive than mechanical push-to-open systems. Accordingly, it would be desirable to provide a push-to-open system that can be used with an appliance door but that is smaller and less expensive than known electromechanical push-to-open systems.

SUMMARY OF THE INVENTION

The present invention achieves the above goal through a push-to-open system that is coupled to an appliance door of a built-in appliance. The push-to-open system includes an arm, a push latch and a spring. The arm is configured to connect the appliance door to a cabinet door, and the push latch is configured to selectively lock the arm in a locked position. The spring is configured to cause movement of the arm from the locked position to an unlocked position when the push latch is unlocked.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE INVENTION

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting but merely as a representative basis for teaching one skilled in the art how to construct and employ the present invention.

Figure 1:
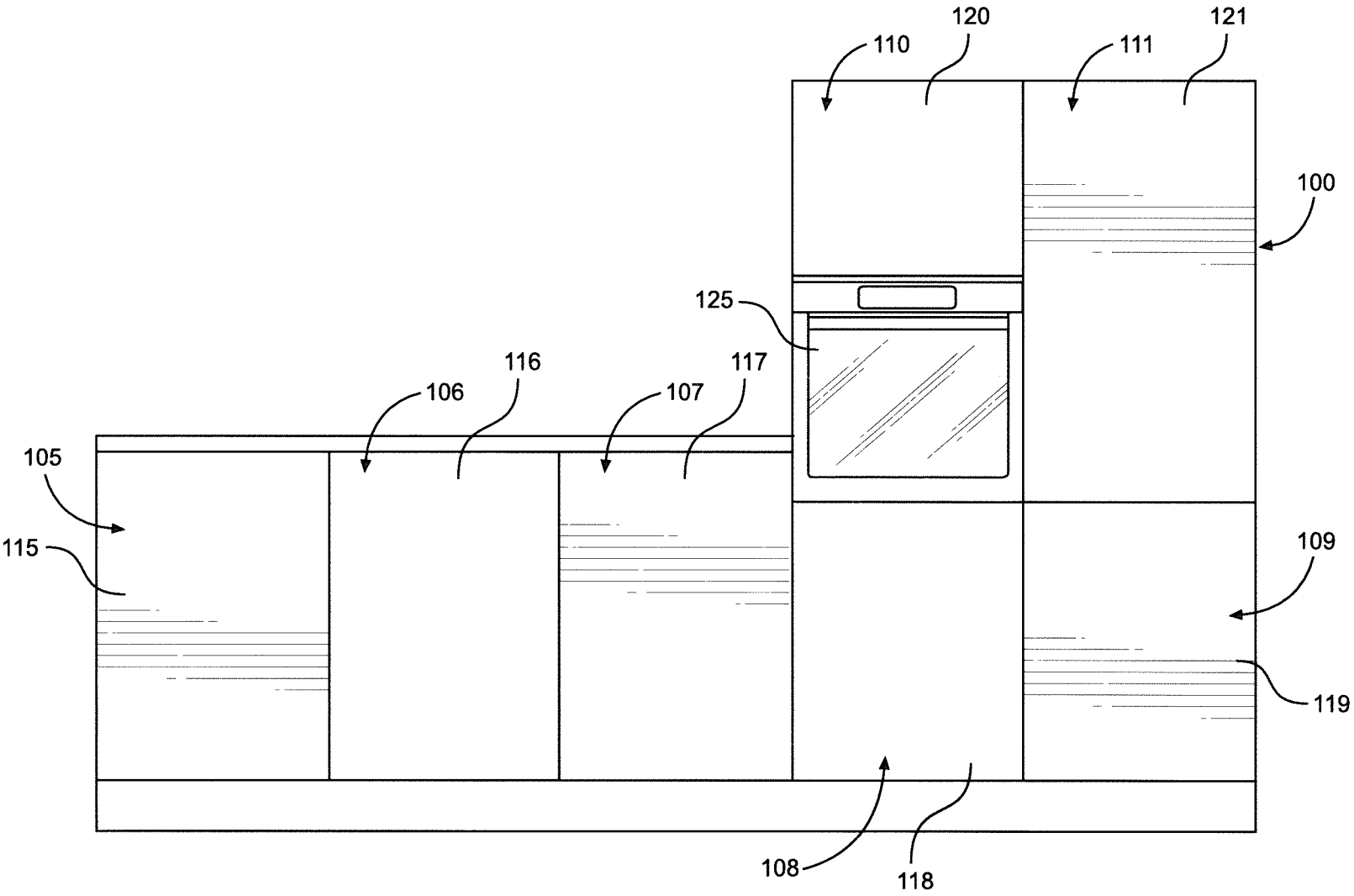
FIG. 1 is a front view of cabinetry incorporating a push-to-open system constructed in accordance with the present invention.

With initial reference to FIG. 1, there is illustrated cabinetry 100, which incorporates a push-to-open system according to the present invention. Cabinetry 100 includes a plurality of cabinets 105-111 having corresponding cabinet doors 115-121. In addition, an oven 125 is installed within cabinetry 100. As is common, some of cabinets 105-111 are configured to be used for storage, with each of the storage cabinets optionally having one or more shelves for supporting items (not shown). In the context of kitchen cabinets, such items can include cookware (e.g., pots or pans) as well as food items (e.g., pasta or spices). Other of cabinets 105-111 are configured to conceal appliances installed therein (i.e., built-in appliances). Specifically, a refrigerator (not visible) is installed within cabinets 109 and 111 such that cabinet door 119 corresponds to a freezer compartment of the refrigerator and cabinet door 121 corresponds to a fresh food compartment of the refrigerator. Of course, it should be recognized that other types of appliances can be concealed within cabinetry 100. For example, a dishwasher can be installed within cabinet 106.

Figure 2:
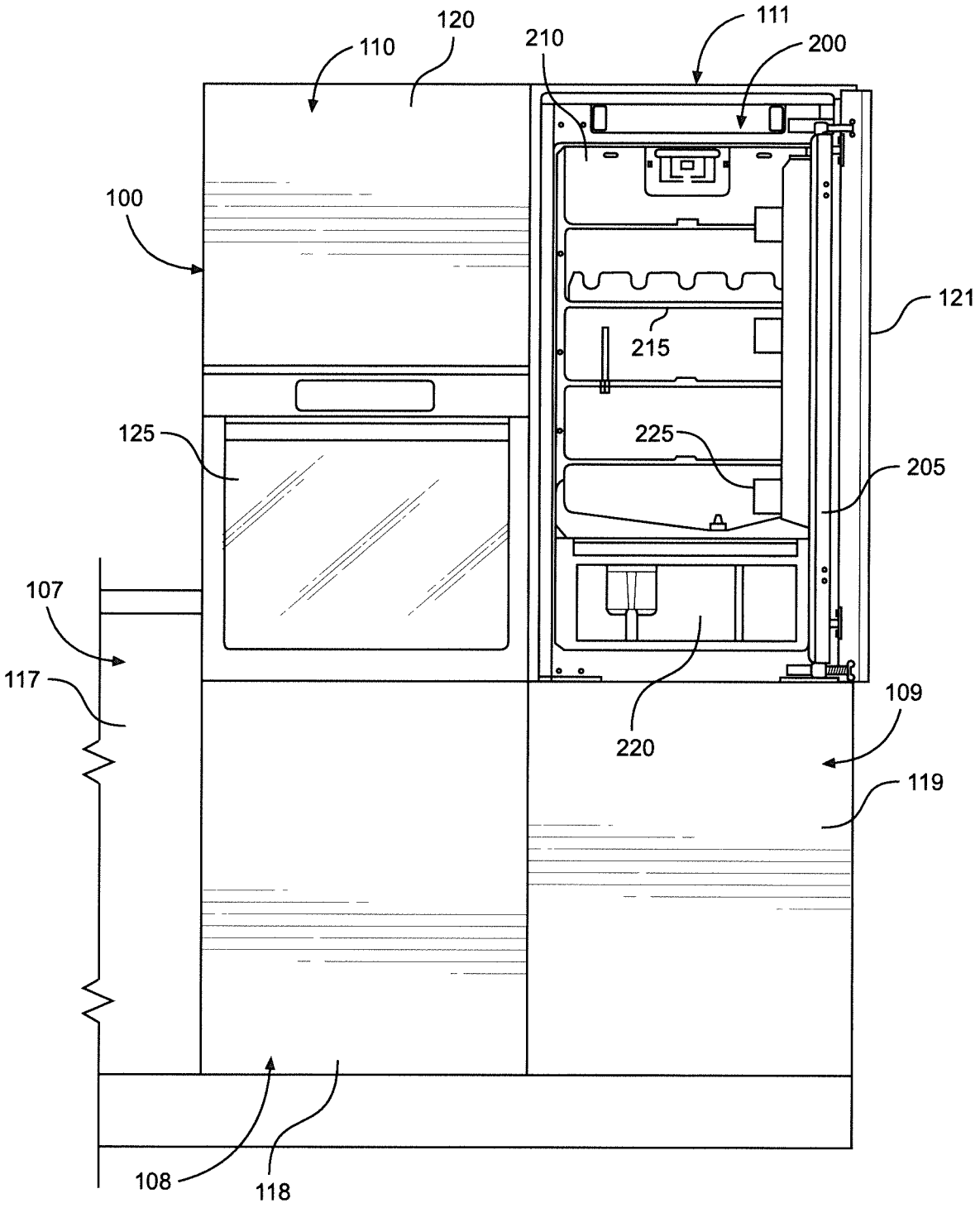
FIG. 2 is a front view of the cabinetry, showing one of the cabinets open to reveal a refrigerator within.

Turning to FIG. 2, a portion of cabinetry 100 is shown, with cabinet door 121 open to reveal a built-in refrigerator 200. Refrigerator 200 includes a fresh food door 205, which selectively seals a fresh food compartment 210, and a freezer door (not visible), which selectively seals a freezer compartment (not visible). For completeness, refrigerator 200 also includes a plurality of shelves (one of which is labeled 215), a drawer 220 and a plurality of door bins (one of which is labeled 225). Although not visible, refrigerator 200 includes a refrigeration system that establishes above and below freezing temperatures in fresh food compartment 210 and the freezer compartment in a manner widely known in the art.

As will be discussed in more detail below, fresh food door 205 is coupled to cabinet door 121 to enable a user to open fresh food door 205 without having to directly interact with fresh food door 205. This allows fresh food door 205 to be concealed behind cabinet door 121 without impairing the use of refrigerator 200. This same goal is also achieved for the freezer door by coupling the freezer door to cabinet door 119.

Figure 3:
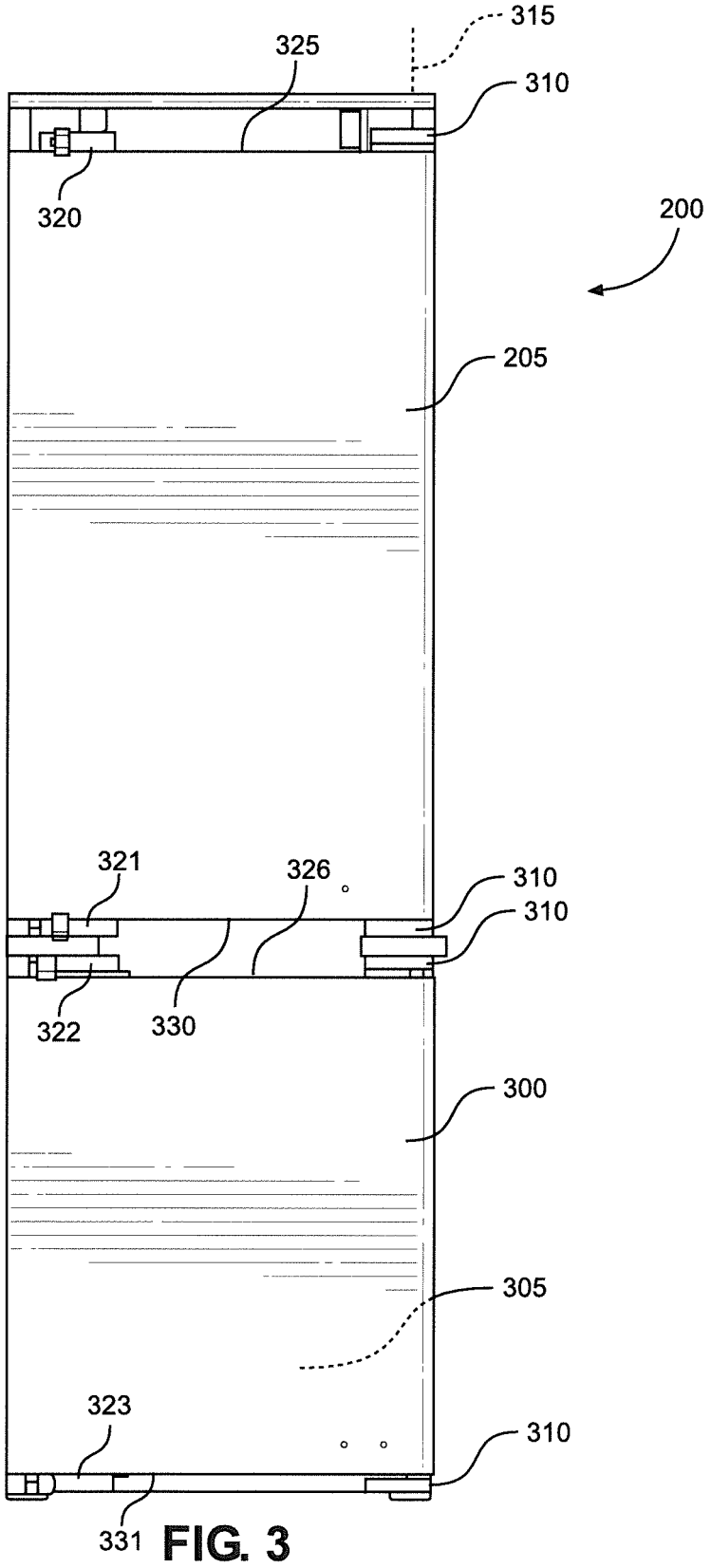
FIG. 3 is a front view of the refrigerator separate from the cabinetry.

With reference now to FIG. 3, refrigerator 200 is shown separate from cabinetry 100. Accordingly, a freezer door 300 is now visible, with a freezer compartment 305 being located behind and selectively sealed by freezer door 300. Refrigerator 200 is shown in a bottom mount configuration. However, the present invention can be used with other refrigerator configurations, including top mount, side-by-side, French door and single door configurations, so long as corresponding changes are made to cabinetry 100 so that the cabinet door arrangement matches the refrigerator door arrangement.

In the embodiment illustrated, fresh food door 205 and freezer door 300 are coupled to the remainder of refrigerator 200 by hinges 310 located on the right side of refrigerator 200 (relative to the view shown in FIG. 3). As a result, fresh food door 205 and freezer door 300 pivot about a vertical axis 315. Push-to-open systems 320-323 are located on the opposite side of refrigerator 200, i.e., on the left side relative to the view shown in FIG. 3. In particular, push-to-open systems 320 and 321 are coupled to a top 325 and a bottom 330 of fresh food door 205, respectively. Similarly, push-to-open systems 322 and 323 are coupled to a top 326 and a bottom 331 of freezer door 300. Push-to-open systems 320 and 321 connect fresh food door 205 to cabinet door 121 when refrigerator 200 is installed within cabinetry 100, while push-to-open systems 322 and 323 connect freezer door 300 to cabinet door 119. In an alternative embodiment, the positions of hinges 310 and push-to-open systems 320-323 are swapped, i.e., hinges 310 are located on the left side of refrigerator 200, and push-to-open systems 320-323 are located on the right side.

Figure 4:
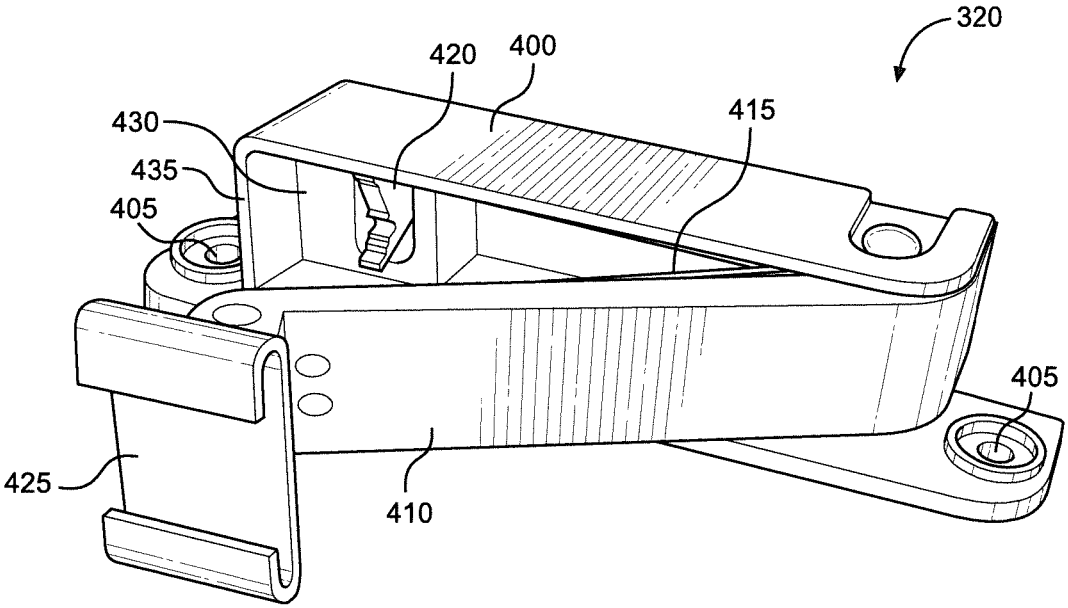
FIG. 4 is a perspective view of a first push-to-open system of the present invention.

FIG. 4 shows push-to-open system 320 in more detail. Push-to-open system 320 includes a base 400 and a pair of mounting holes 405, through which a corresponding pair of fasteners (not shown in FIG. 4) is inserted to removably secure base 400 to fresh food door 205. Push-to-open system 320 also includes an arm 410 pivotally coupled to base 400, a spring 415 configured to cause arm 410 to pivot outward, away from base 400, and a push latch 420 configured to selectively lock arm 410 in place. In addition, a slide 425, in the form of a hook, is pivotally coupled to arm 410. Base 400 defines an interior 430 and an opening 435, through which interior 430 is accessible. Spring 415 and push latch 420 are located within interior 430, while arm 410 pivots through opening 435 to be selectively received in interior 430.

Figure 5:
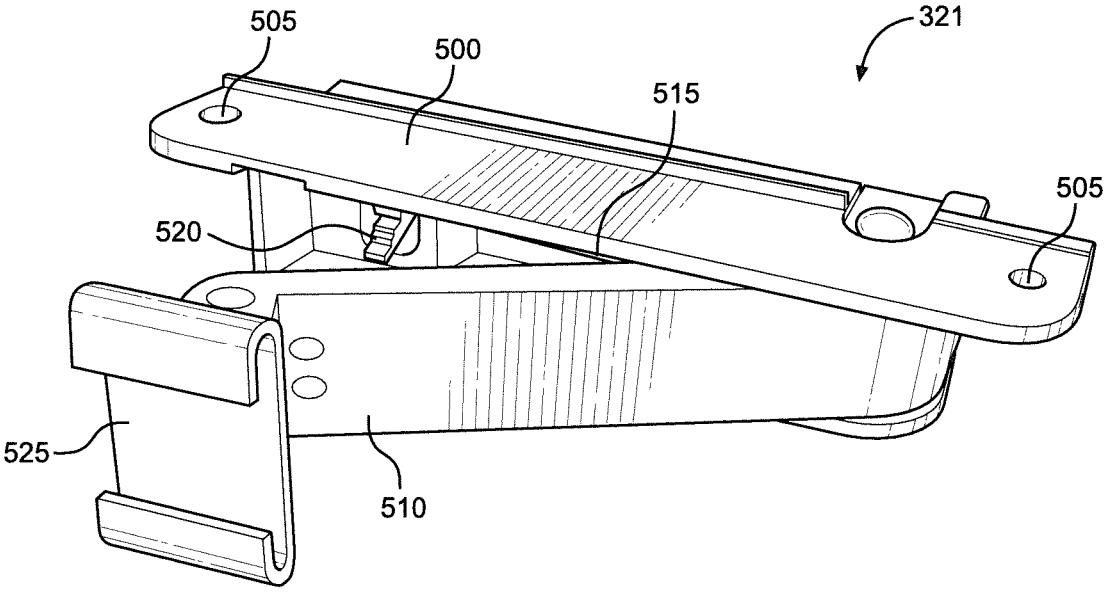
FIG. 5 is a perspective view of a second push-to-open system of the present invention.

FIG. 5 shows push-to-open system 321, which is essentially a mirror image of push-to-open system 320 since push-to-open system 321 is designed to be coupled to bottom 330 rather than top 325 of fresh food door 205. Therefore, like push-to-open system 320, push-to-open system 321 includes a base 500, a pair of mounting holes 505, an arm 510, a spring 515, a push latch 520 and a slide 525. Push-to-open system 323 is constructed in an identical manner to push-to-open system 321. Likewise, push-to-open system 322 is constructed in an identical manner to push-to-open system 320. Accordingly, push-to-open systems 322 and 323 will not be discussed in detail.

Figure 6:
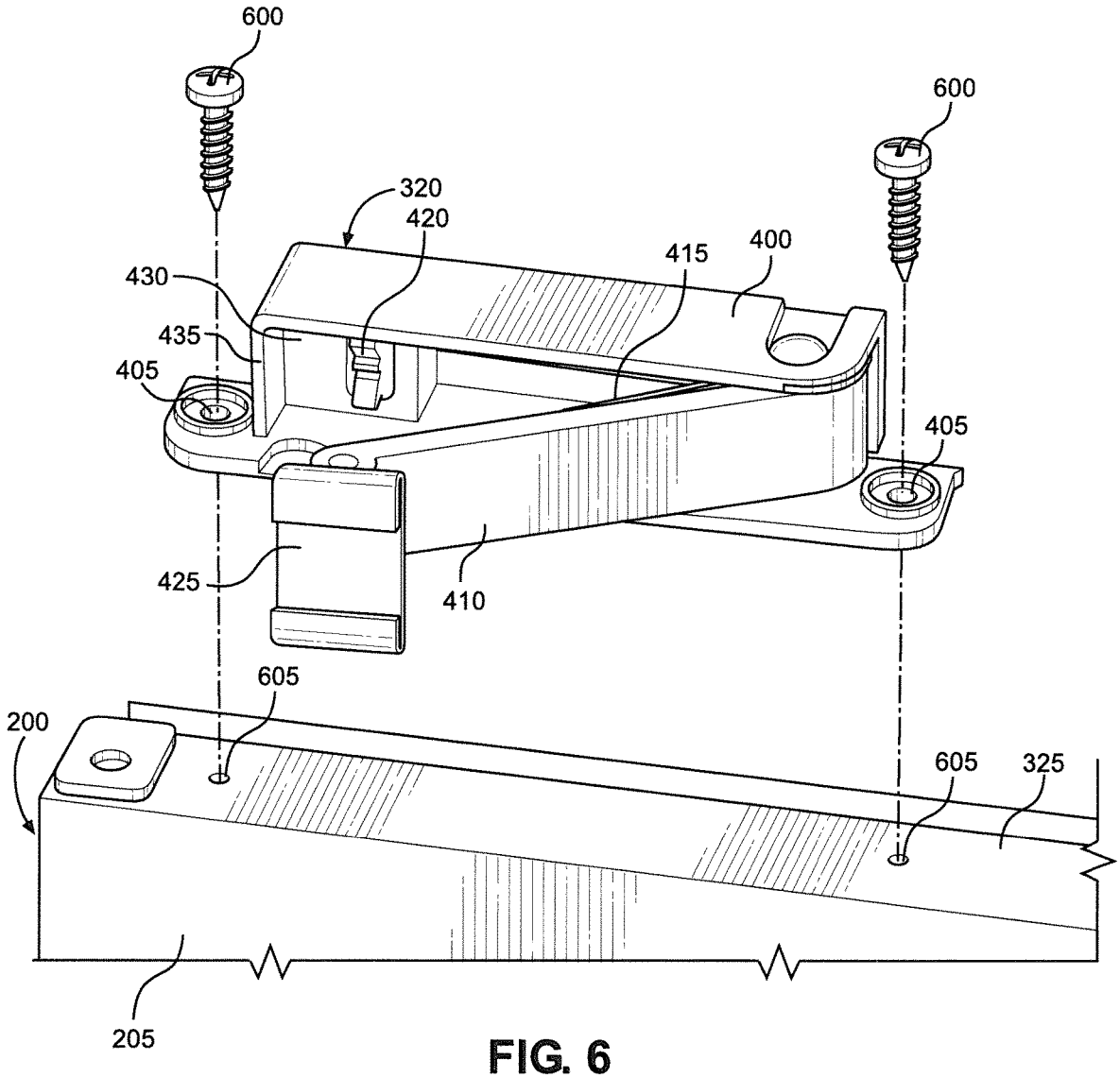
FIG. 6 is an exploded perspective view of the first push-to-open system and the refrigerator.

Turning to FIG. 6, an exploded view of push-to-open system 320 and fresh food door 205 is provided. Push-to-open system 320 is removably coupled to top 325 of fresh food door 205 by fasteners 600, which are inserted through mounting holes 405 of base 400 into corresponding mounting holes 605 of fresh food door 205. Push-to-open systems 321-323 are coupled to fresh food door 205 or freezer door 300 in the same manner. However, it should be recognized that other coupling mechanisms can be used to secure push-to-open systems 320-323 to refrigerator 200.

Figure 7:
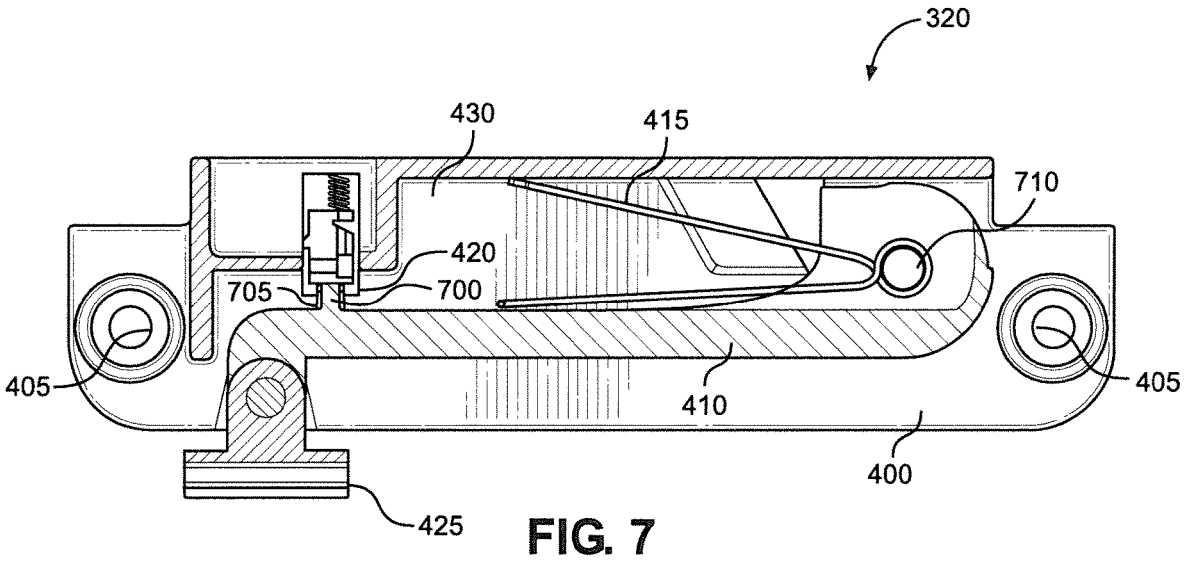
FIG. 7 is a horizontal cross section of the first push-to-open system in a closed position.

With reference now to FIG. 7, push-to-open system 320 is shown in cross section. This view highlights the interaction between arm 410 and push latch 420. Specifically, a plunger 700 extends rearward from arm 410 and mates with a receiver 705 of push latch 420. While plunger 700 and receiver 705 are in contact, push latch 420 locks arm 410 in place in a locked position, as shown in FIG. 7. Push latch 420 is unlocked by forcing plunger 700 further into push latch 420. As will be discussed in more detail below, this can be accomplished by pushing cabinet door 121 inward toward fresh food door 205. Once push latch 420 is unlocked, arm 410 is free to move. Since spring 415 biases arm 410 outward, away from base 400, arm 410 now pivots counterclockwise (relative to the view shown in FIG. 7) about a point 710, which corresponds to a rivet in the embodiment illustrated. Although spring 415 is depicted as a torsion spring, spring 415 can be another type of spring. In addition, the positions of plunger 700 and receiver 705 can be reversed. That is, plunger 700 can be fixed to base 400, with push latch 420 attached to arm 410.

Figure 8:
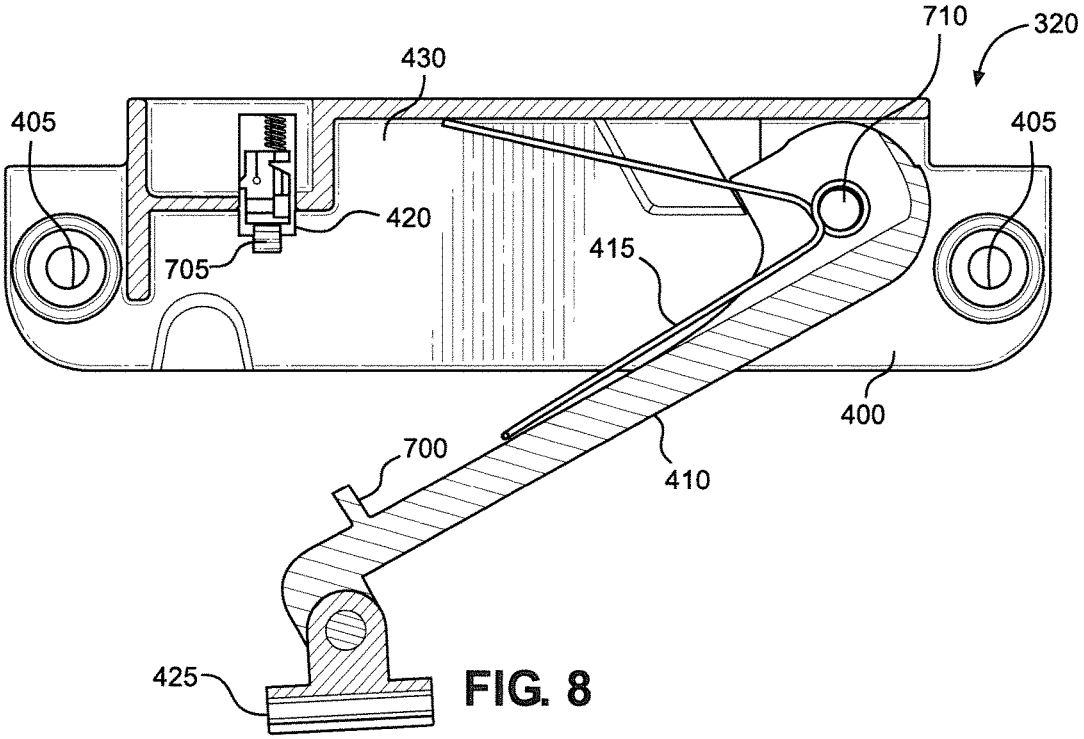
FIG. 8 is a horizontal cross section of the first push-to-open system in an open position.

FIG. 8 shows arm 410 in an unlocked position. For purposes of the present invention, an unlocked position of arm 410 corresponds to any of the positions arm 410 adopts when not locked in place by push latch 420. In particular, arm 410 is shown in its neutral position in FIG. 8, i.e., the position where it would be when no force is exerted counter to the force of spring 415. To lock arm 410, arm 410 is pushed inward toward push latch 420 such that arm 410 pivots about point 710 in a clockwise direction (relative to the view shown in FIG. 8). As with the unlocking of push latch 420, this can be accomplished by pushing cabinet door 121 inward toward fresh food door 205. Once plunger 700 is received within receiver 705, arm 410 is locked in place by push latch 420.

Figure 9:
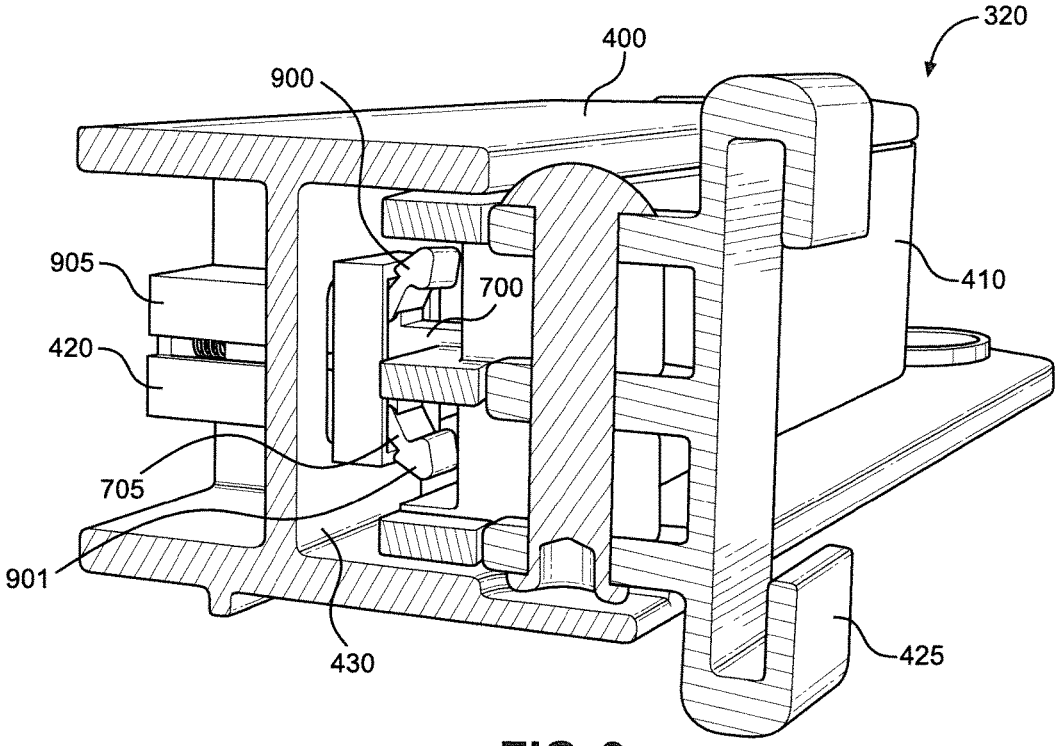
FIG. 9 is a vertical cross section of the first push-to-open system in a closed position.

Turning to FIG. 9, the interaction between plunger 700 and receiver 705 is shown in more detail. Specifically, it can be seen that receiver 705 has arms 900 and 901 that grip plunger 700 to prevent plunger 700 from moving outward, away from push latch 420. In addition, receiver 705 is located within a body 905 of push latch 420. Movement of receiver 705 within body 905 alters the position of arms 900 and 901, with inward movement of receiver 705 (relative to the position shown in FIG. 9) causing arms 900 and 901 to release plunger 700, unlocking push latch 420.

Figure 10:
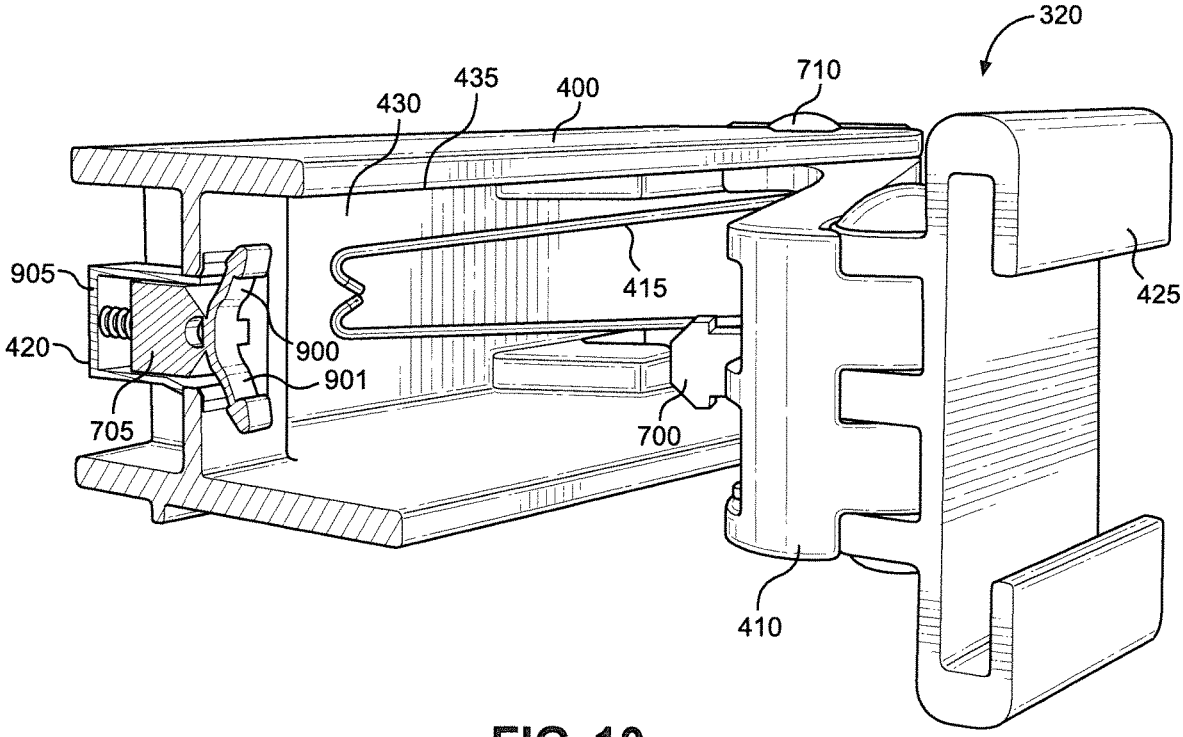
FIG. 10 is a vertical cross section of the first push-to-open system in an open position.

FIG. 10 shows plunger 700 and receiver 705 when arm 410 is in an unlocked position. When plunger 700 is pushed into contact with receiver 705, receiver 705 moves further inward into body 905 (relative to the position shown in FIG. 10), which causes arms 900 and 901 to pivot and grip plunger 700, locking push latch 420.

Figure 11:
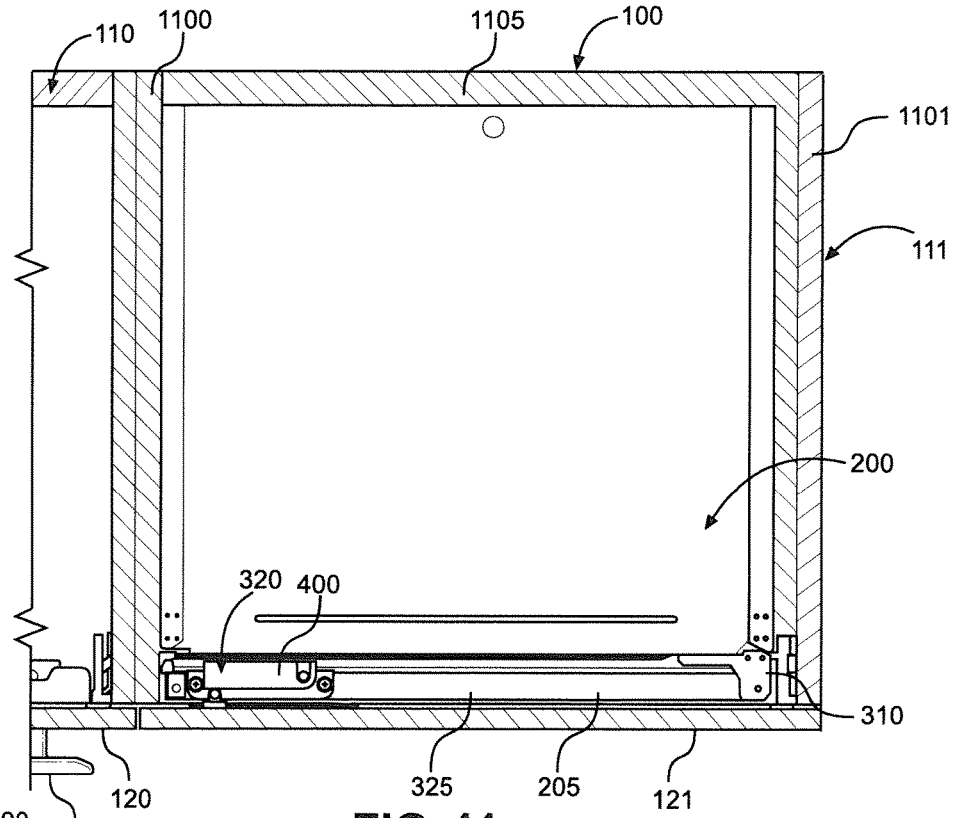
FIG. 11 is a horizontal cross section of the cabinetry, showing a cabinet door for a fresh food compartment of the refrigerator in a closed position.

With reference now to FIG. 11, a cross section of cabinetry 100 is provided, with cabinet door 121 shown in the closed position. Cabinet door 119 is also in the closed position but cannot be seen in FIG. 11. Refrigerator 200 is surrounded by sidewalls 1100 and 1101 and rear wall 1105 of cabinet 111 as well as corresponding walls of cabinet 109 (not shown). As a result, refrigerator 200 is not visible from outside of cabinets 109 and 111.

Figure 12:
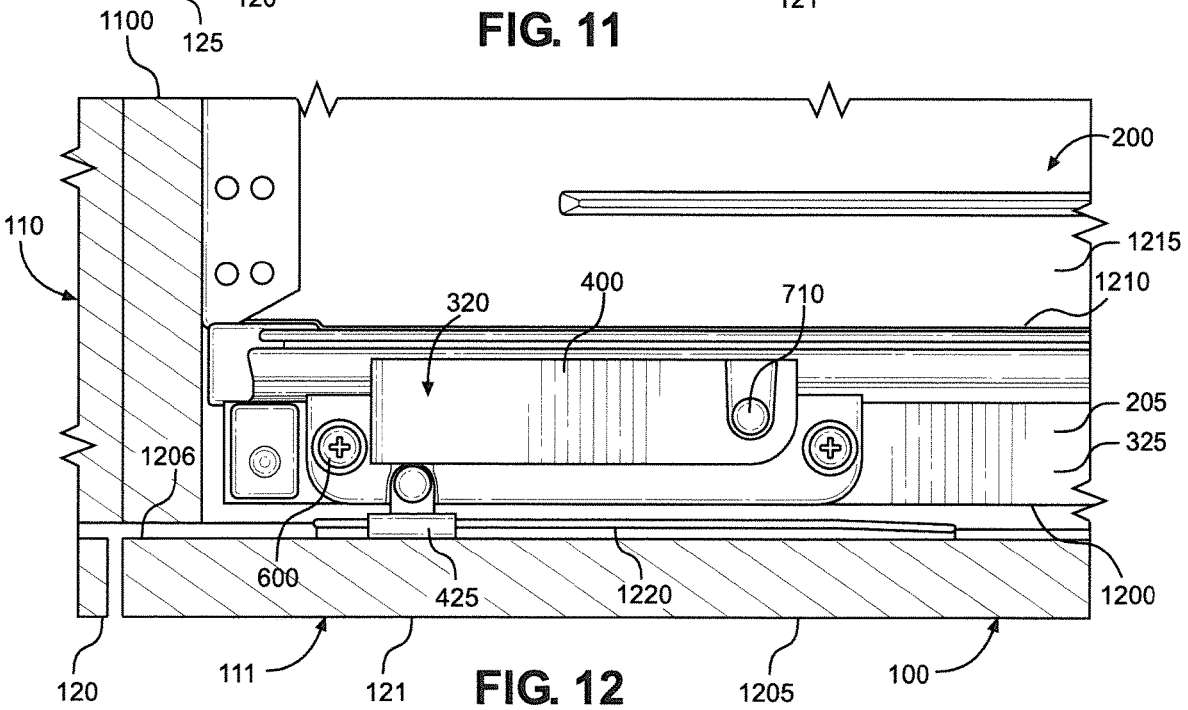
FIG. 12 is an enlarged view of a portion of FIG. 11.

Push-to-open system 320 can be seen coupled to top 325 of fresh food door 205, with FIG. 12 showing this more clearly. Base 400 does not extend forward from fresh food door 205, i.e., beyond a front face 1200 of fresh food door 205, which helps provide a more compact door opening arrangement. In one embodiment, the distance from a front face 1205 of cabinet door 121 (or cabinet door 119) to a front face 1210 of a cabinet 1215 of refrigerator 200 is 46 millimeters. This is the same distance as in certain prior art refrigerator installations that do not employ push-to-open systems. Additionally, the distance from a rear face 1206 of cabinet door 121 (or cabinet door 119) to the remainder of cabinet 111 (or cabinet 109) is only 3 millimeters.

Figure 13:
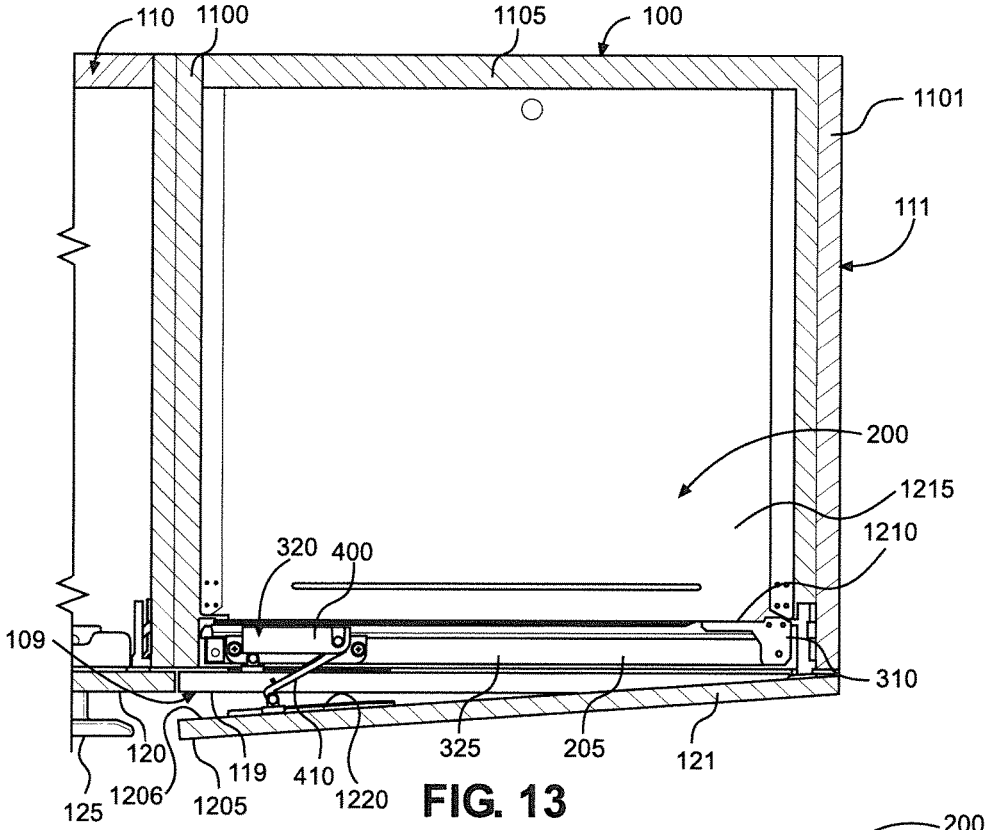
FIG. 13 is a horizontal cross section of the cabinetry, showing the cabinet door for the fresh food compartment in an open position.

FIG. 12 also shows the connection between cabinet door 121 and push-to-open system 320. A runner 1220 of push-to-open system 320 is coupled to rear face 1206 of cabinet door 121, with slide 425 coupled to and sliding along runner 1220 as cabinet door 121 moves relative to fresh food door 205. Due to this connection, when a user pushes cabinet door 121 inward toward fresh food door 205, arm 410 is forced further into base 400, which causes plunger 700 to be forced further into push latch 420 (not visible in FIG. 12). This unlocks push latch 420, causing arm 410 to move from the locked position, shown in FIGS. 11 and 12, to an unlocked position, shown in FIGS. 13 and 14.

With arm 410 in an unlocked position, the gap between cabinet door 121 and the rest of cabinetry 100, as well as between cabinet door 121 and fresh food door 205, is now sufficiently large that a user is able to insert his or her hand behind cabinet door 121 to grasp cabinet door 121. Since cabinet door 121 is coupled to fresh food door 205 by push-to-open system 320, pulling cabinet door 121 outward, away from the remainder of cabinet 111, also opens fresh food door 205. In other words, cabinet door 121 essentially acts as a handle for fresh food door 205, allowing cabinet door 121 and fresh food door 205 to be handle-less. In one embodiment, cabinet door 121 is positioned at about 4° relative to the remainder of cabinet 111 when arm 410 is in its neutral position, which creates either 25 or 45 millimeters of space for the user's hand, depending on whether another cabinet door is located adjacent to the gap (e.g., cabinet door 120).

Along these lines, it should be emphasized that, unlike certain prior art push-to-open systems, push-to-open system 320 does not open fresh food door 205. Instead, push-to-open system 320 causes relative movement between cabinet door 121 and fresh food door 205, enabling the user to open fresh food door 205 using cabinet door 121. This relative movement should be apparent when comparing FIG. 14 to FIG. 12, as no movement of fresh food door 205 takes place between these figures. As a result of this arrangement, push-to-open system 320 does not need to be designed to produce as much force as would be required if push-to-open system 320 were to directly act on fresh food door 205, allowing for a simpler and less inexpensive system.

Figure 14:
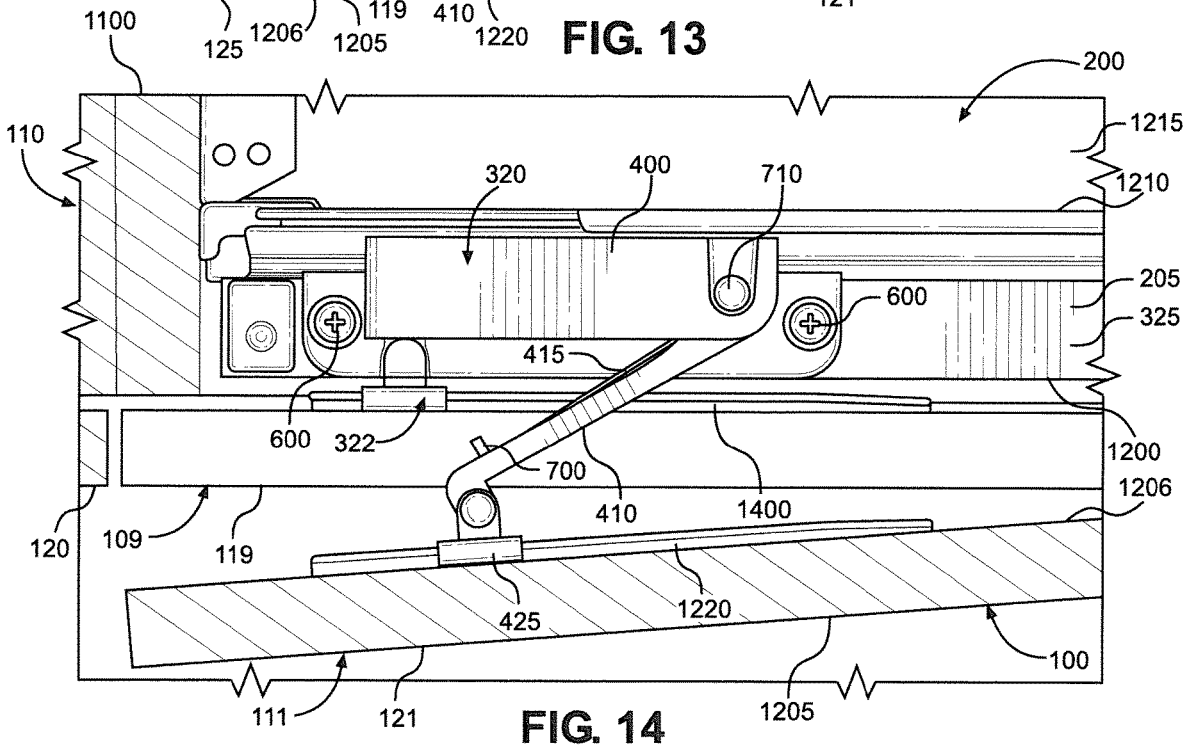
FIG. 14 is an enlarged view of a portion of FIG. 13.

Comparing FIG. 14 to FIG. 12 also shows that slide 425 moves along runner 1220 during relative movement of cabinet door 121 and fresh food door 205 to accommodate the differential movement of doors 121 and 205 during opening of fresh food door 205. In addition, with arm 410 in an unlocked position in FIG. 14, cabinet door 119 and a portion of push-to-open system 322 can be seen, including a runner 1400. In general, push-to-open systems 321-323 are coupled to cabinet door 119 or 121 in the same manner as push-to-open system 320 and function in the same manner as push-to-open system 320, with cabinet door 119 being used to open freezer door 300 in the same way cabinet door 121 is used to open fresh food door 205. Accordingly, push-to-open systems 321-323, cabinet door 119 and freezer door 300 will not be discussed in detail.

Figure 15:
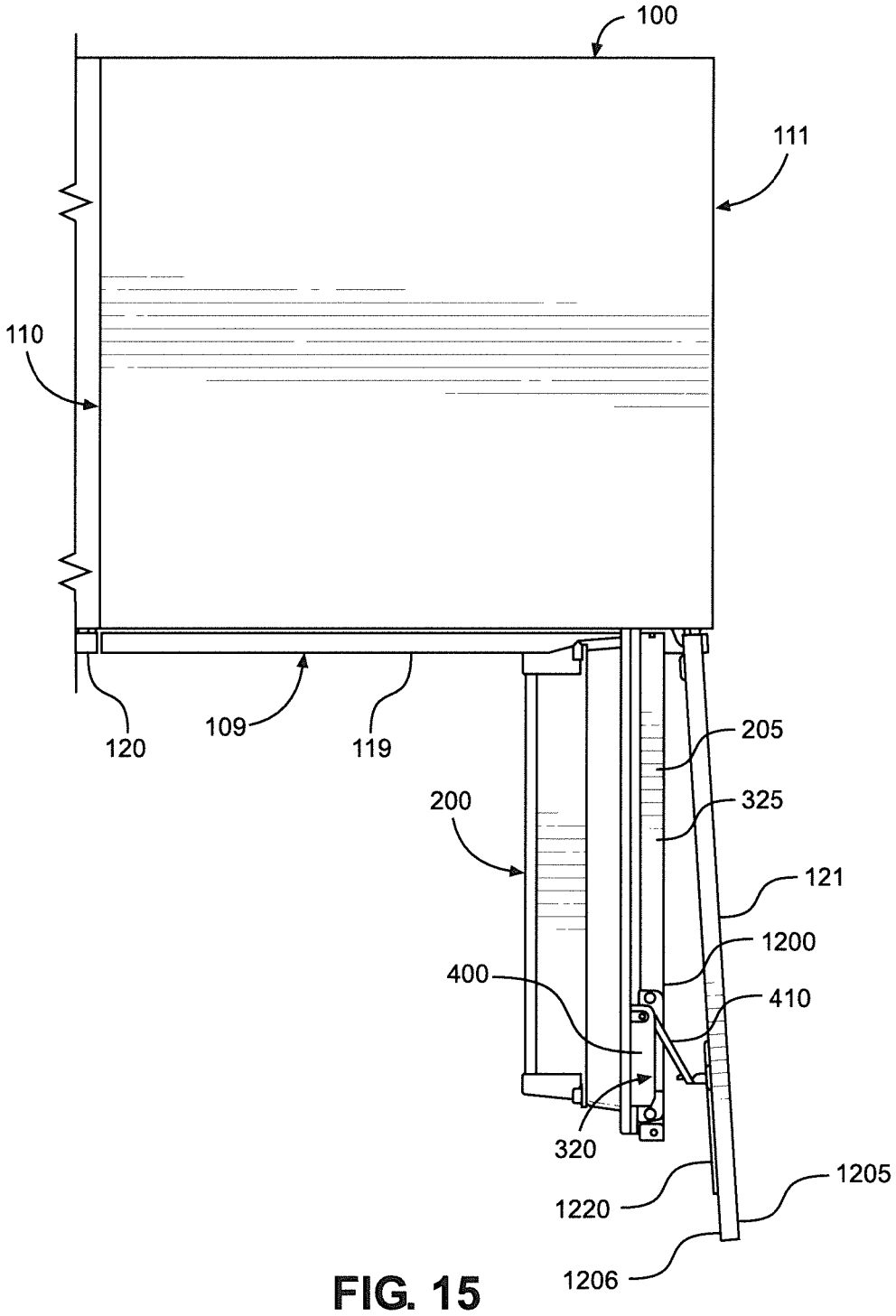
FIG. 15 is a top view of the cabinetry, showing a fresh food door of the refrigerator in an open position.
Figure 16:
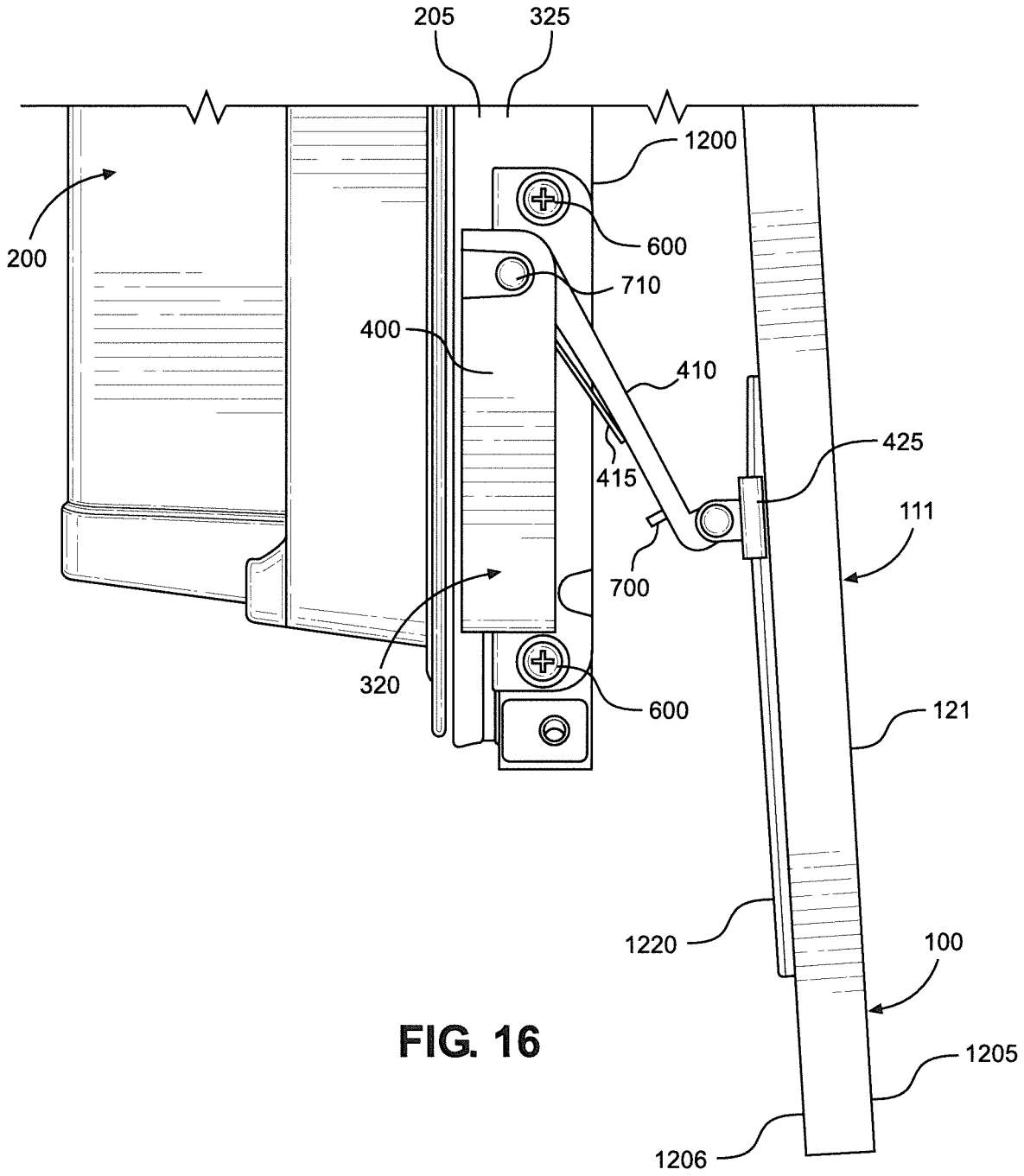
FIG. 16 is an enlarged view of a portion of FIG. 15.

Turning to FIGS. 15 and 16, fresh food door 205 is shown in an open position. Specifically, fresh food door 205 is positioned at 90° relative to the remainder of refrigerator 200 (not visible in FIGS. 15 and 16), and cabinet door 121 is positioned at about 94° relative to the remainder of cabinet 111. In one embodiment, this results in cabinet door 121 extending only 28 millimeters rightward past sidewall 1101 of cabinet 111 (relative to the view of FIG. 15). This view also illustrates the movement of slide 425 relative to runner 1220 as fresh food door 205 and cabinet door 121 pivot.

Although described in connection with a refrigerator, it should be recognized that the push-to-open system of the present invention can be used with other appliances. For example, the push-to-open system can be used with a dishwasher or microwave installed within a cabinet. With respect to dishwashers, where the doors typically pivot about horizontal axes, the push-to-open system can be rotated 90°. Furthermore, while the embodiment illustrated utilizes two push-to-open systems per door, this is not required. Nor do the push-to-open systems need to be provided at the top or bottom of a door. Instead, for example, a push-to-open system can be provided in a recess in a center of a door.

Based on the above, it should be readily apparent that the present invention provides a push-to-open system that can be used with an appliance door but that is smaller and less expensive than an electromechanical push-to-open system. While certain preferred embodiments of the present invention have been set forth, it should be understood that various changes or modifications could be made without departing from the spirit of the present invention. In general, the invention is only intended to be limited by the scope of the following claims.

The invention claimed is:

1. An apparatus comprising:
an appliance including:
a compartment; and
an appliance door configured to selectively seal the compartment;
a push-to-open system coupled to the appliance door, the push-to-open system including:
an arm configured to connect the appliance door to a cabinet door;
a push latch configured to selectively lock the arm in a locked position; and
a spring configured to cause movement of the arm from the locked position to an unlocked position when the push latch is unlocked.

2. The apparatus of claim 1, wherein the apparatus is configured such that, when the appliance is installed within a cabinet with the arm connecting the appliance door to the cabinet door, movement of the arm from the locked position to the unlocked position causes movement of the cabinet door relative to the appliance door, enabling a user to grasp the cabinet door and pull on the cabinet door to open the appliance door.

3. The apparatus of claim 1, wherein the arm is configured to pivot relative to the appliance door.

4. The apparatus of claim 1, wherein the arm is configured to pivot between the locked and unlocked positions.

5. The apparatus of claim 1, wherein the apparatus is configured such that, when the appliance is installed within a cabinet with the arm connecting the appliance door to the cabinet door, pushing the cabinet door towards the appliance door unlocks the push latch.

6. The apparatus of claim 1, wherein one of the push latch and the arm has a receiver and the other of the push latch and the arm has a plunger configured to selectively mate with the receiver.

7. The apparatus of claim 1, wherein the push-to-open system further includes:

a runner configured to be coupled to the cabinet door; and a slide coupled to the arm and configured to move along the runner.

8. The apparatus of claim 1, wherein the appliance door does not include a handle.

9. The apparatus of claim 1, wherein the appliance is a refrigerator, the compartment is a fresh food compartment or a freezer compartment, and the appliance door is a refrigerator door.

10. The apparatus of claim 1, wherein the apparatus further comprises a cabinet including the cabinet door, the appliance is located within the cabinet such that the appliance is not visible from outside the cabinet when the cabinet door is closed, and the cabinet door does not include a handle.

11. The apparatus of claim 1, wherein the push-to-open system is directly coupled to the cabinet door.

12. A push-to-open system comprising:

an arm configured to connect an appliance door to a cabinet door;

a push latch configured to selectively lock the arm in a locked position; and a spring configured to cause movement of the arm from the locked position to an unlocked position when the push latch is unlocked.

13. The push-to-open system of claim 12, wherein the push-to-open system is configured such that, when the arm connects the appliance door to the cabinet door, movement of the arm from the locked position to the unlocked position causes movement of the cabinet door relative to the appliance door, enabling a user to grasp the cabinet door and pull on the cabinet door to open the appliance door.

14. The push-to-open system of claim 12, wherein the arm is configured to pivot relative to the appliance door.

15. The push-to-open system of claim 12, wherein the arm is configured to pivot between the locked and unlocked positions.

16. The push-to-open system of claim 12, wherein the push-to-open system is configured such that, when the arm connects the appliance door to the cabinet door, pushing the cabinet door towards the appliance door unlocks the push latch.

17. The push-to-open system of claim 12, wherein one of the push latch and the arm has a receiver and the other of the push latch and the arm has a plunger configured to selectively mate with the receiver.

18. The push-to-open system of claim 12, further comprising:

a runner configured to be coupled to the cabinet door; and a slide coupled to the arm and configured to move along the runner.

19. A method of installing a push-to-open system, the method comprising:

coupling the push-to-open system to an appliance door of an appliance, wherein the appliance includes a compartment, and the appliance door is configured to selectively seal the compartment; and connecting the appliance door to a cabinet door with an arm of the push-to-open system, wherein the push-to-open system includes a push latch configured to selectively lock the arm in a locked position and a spring configured to cause movement of the arm from the locked position to an unlocked position when the push latch is unlocked.

20. The method of claim 19, wherein the compartment is a fresh food compartment or a freezer compartment of a refrigerator.

21. The method of claim 19, wherein connecting the appliance door to the cabinet door includes connecting the appliance door to the cabinet door of a cabinet in which the appliance is located such that the appliance is not visible from outside the cabinet when the cabinet door is closed.

* * * * *